US008644116B2

(12) United States Patent
Gabathuler et al.

(10) Patent No.: US 8,644,116 B2
(45) Date of Patent: Feb. 4, 2014

(54) CALENDAR MECHANISM

(75) Inventors: Jacques Gabathuler, Chene-Bougeries (CH); Trung Thanh Nguyen, Bernex (CH); Serge Nicollin, Geneva (CH); Florent Zufferey, Le Grand-Saconnex (CH)

(73) Assignee: Breitling AG, Grenchen (CH)

( * ) Notice: Subject to any disclaimer, the term of this patent is extended or adjusted under 35 U.S.C. 154(b) by 8 days.

(21) Appl. No.: 13/561,541

(22) Filed: Jul. 30, 2012

(65) Prior Publication Data

US 2013/0051183 A1 Feb. 28, 2013

(30) Foreign Application Priority Data

Aug. 30, 2011 (EP) ..... 11007040

(51) Int. Cl.
*G04B 19/20* (2006.01)

(52) U.S. Cl.
USPC ..... 368/35; 368/37

(58) Field of Classification Search
USPC ..... 368/28, 35–38
See application file for complete search history.

(56) References Cited

U.S. PATENT DOCUMENTS

| | | | | |
|---|---|---|---|---|
| 3,633,354 | A * | 1/1972 | Stemmler | 368/27 |
| 4,427,300 | A | 1/1984 | Groothuis | |
| 5,708,628 | A * | 1/1998 | Chen | 368/21 |
| 5,956,294 | A * | 9/1999 | Takizawa et al. | 368/37 |
| 6,295,250 | B1 * | 9/2001 | Ray et al. | 368/37 |
| 7,038,974 | B2 | 5/2006 | Dalloz | |
| 7,158,448 | B1 | 1/2007 | Gabathuler et al. | |
| 7,242,640 | B2 * | 7/2007 | Fleury | 368/38 |
| 7,826,311 | B2 * | 11/2010 | Lin | 368/22 |
| 8,036,066 | B2 * | 10/2011 | Schlencker et al. | 368/22 |

FOREIGN PATENT DOCUMENTS

| | | |
|---|---|---|
| EP | 0052070 A1 | 2/1985 |
| EP | 1746470 A1 | 1/2007 |
| EP | 1524564 B1 | 7/2007 |

OTHER PUBLICATIONS

European Search Report dated Mar. 21, 2012, from corresponding EP application.

* cited by examiner

*Primary Examiner* — Vit W Miska
(74) *Attorney, Agent, or Firm* — Young & Thompson

(57) ABSTRACT

Calendar mechanism for a timepiece, includes:
at least one mobile (22; 23) for driving an indicator,
a wheel (1) which, during normal operation of the timepiece, is driven in a first direction (S1),
a lever (16) for actuating the mobile (22; 23), and
first and second cams (2, 3) driven by the wheel (1) and controlling the movements of the actuating lever (16), these first and second cams (2, 3) being arranged so that their relative angular position differs depending on the direction of rotation of the wheel (1) so that the movements of the actuating lever (16) cause the mobile (22; 23) to advance periodically during normal operation of the timepiece and do not permit the mobile to advance during backwards time setting of the timepiece causing the wheel to rotate in a second direction (S2) opposite to the first direction (S1).

14 Claims, 8 Drawing Sheets

CALENDAR MECHANISM

The present invention relates to a calendar mechanism for a timepiece.

"Calendar" is understood to mean in particular the indication of the date and/or the day of the week and/or the month.

More particularly, the present invention relates to a calendar mechanism in which a mobile for driving an indicator, such as a star fixedly attached to the indicator, is actuated by a cam-controlled lever.

In this type of mechanism the cam is fixedly attached to a wheel driven by the going train of the timepiece at a rate of one revolution every 24 hours. The cam is generally of the instantaneous jump type and, to this end, is in the form of a snail comprising a long part with a progressively increasing radius serving to arm the lever and a short part with a negative slope permitting the lever to jump at midnight in order to cause an advance by one step of the mobile which drives a date indicator. A cam of this type does not permit passage through midnight in the reverse direction by a backwards rotation of the wheel because the beak of the lever which cooperates with the cam cannot rise up the negative slope. This prevents time setting of the timepiece in the backwards direction at around midnight.

It is possible to replace such a cam with a cam which does not have a negative slope part and which has a range of angular movement with respect to the wheel, such as the cam described in the patent application EP 1746470 of the present applicant. Thus modified, the calendar mechanism permits backwards time setting at any time including at around midnight. On the other hand, each passage through midnight in the reverse direction will cause the date indicator to advance because the movement of the lever is independent of the direction of rotation of the cam. The user will thus see the date indicator advance, while the hands of the time display move back, which he will perceive as a fault.

The present invention aims to overcome this disadvantage and to this end proposes a calendar mechanism for a timepiece, comprising:

at least one mobile for driving an indicator, a wheel which, during normal operation of the timepiece, is driven in a first direction, and a lever for actuating the mobile, characterised in that it further comprises first and second cams driven by the wheel and controlling the movements of the actuating lever, these first and second cams being arranged so that their relative angular position differs depending on the direction of rotation of the wheel so that the movements of the actuating lever cause the mobile to advance periodically during normal operation of the timepiece and do not permit the mobile to advance during backwards time setting of the timepiece causing the wheel to rotate in a second direction opposite to the first direction.

The first and second cams are typically coaxial to the wheel.

The connection between the wheel, the first cam and the second cam can comprise an oblong opening and a pin engaged in the oblong opening. In one exemplified embodiment, the oblong opening is provided in the wheel, the pin is carried by the first cam and the second cam is fixedly attached to the wheel.

The second cam preferably controls the actuating lever via a second lever. In this case the pivot of the actuating lever is carried by the second lever.

Also in a preferable manner, the first cam controls the actuating lever by means of a third lever. The connection between the actuating lever and the third lever can comprise an oblong opening and a pin engaged in the oblong opening. In one exemplified embodiment, the oblong opening is provided in the actuating lever and the pin is carried by the third lever.

The actuating lever typically comprises at least one beak and is arranged so that during normal operation of the timepiece this beak periodically engages in a toothing of the mobile in order to cause this mobile to advance and so that the engagements of this beak in the toothing of the mobile during backwards time setting of the timepiece have no effect on the angular position of the said mobile.

A device may be provided to cause the beak to automatically leave the toothing of the mobile before a correction of the position of the said mobile.

In one exemplified embodiment, this device can be actuated by a displacement of a winding stem into a predetermined axial position.

This device advantageously comprises means for moving the second lever away from the second cam, this distancing movement causing a displacement of the actuating lever causing the beak to leave the toothing of the mobile.

Other features and advantages of the present invention will become clear from reading the following detailed description given with reference to the attached drawings in which.

Figure 1:
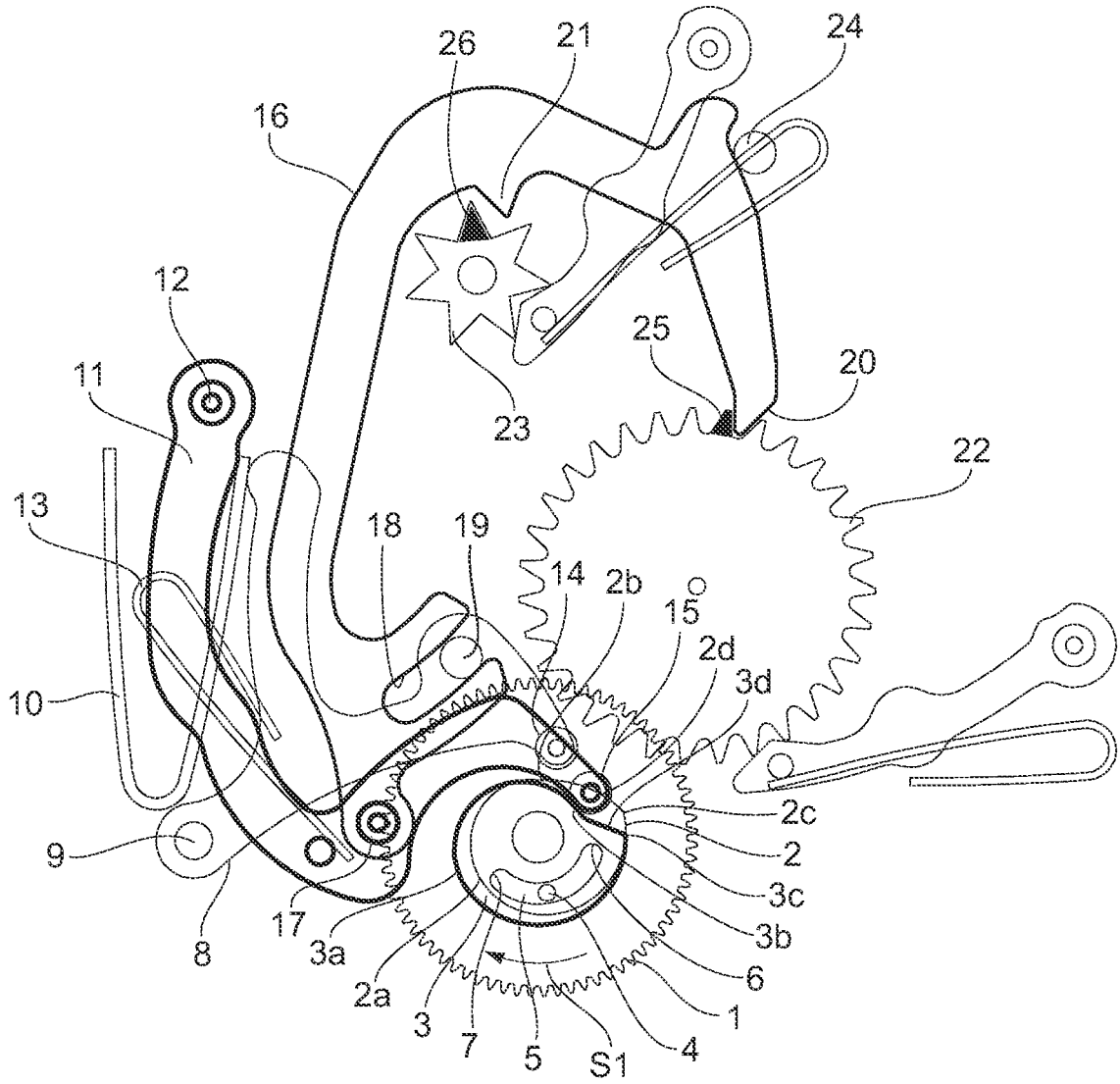
FIG. 1 shows a calendar mechanism according to a first embodiment of the invention; in this figure three levers are shown with different line thicknesses and two cams are shown with different line thicknesses to permit the reader to distinguish them better.
Figure 2A:
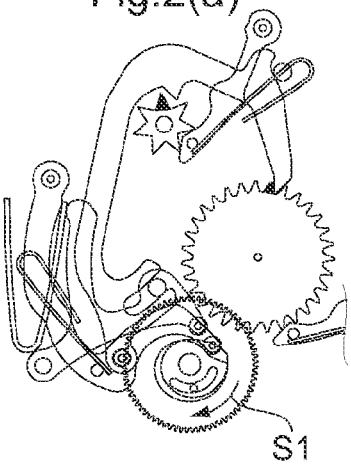
FIG. 2 shows a sequence of states of the calendar mechanism according to the first embodiment during a rotation of the time indicators of the timepiece by a number of revolutions corresponding to 24 hours of time display in the clockwise direction.
Figure 2B:
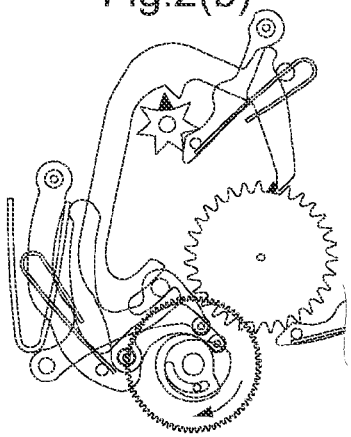
Figure 2C:
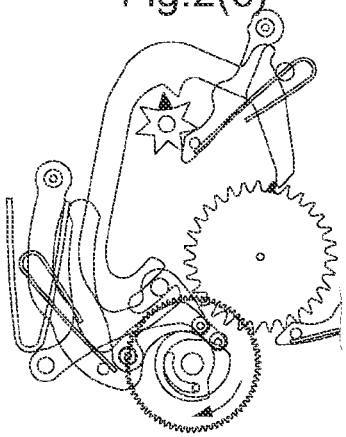
Figure 2D:
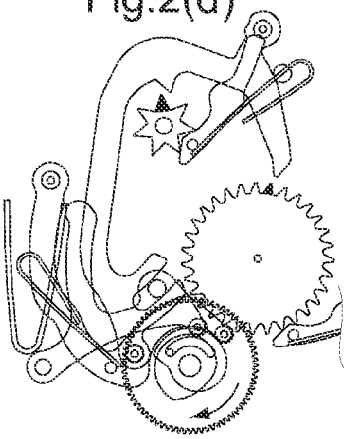
Figure 2E:
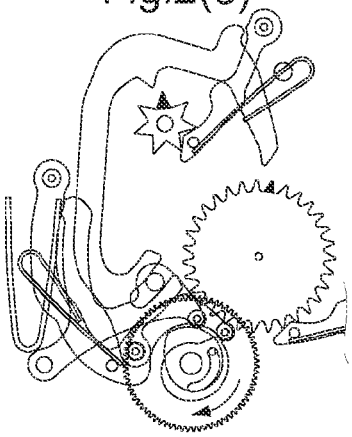
Figure 2F:
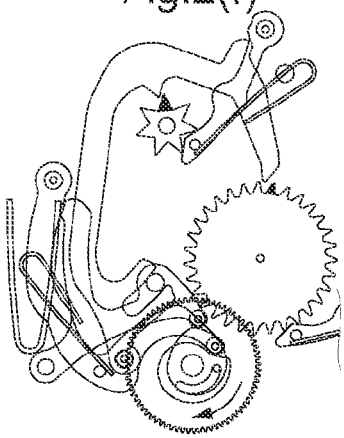
Figure 2G:
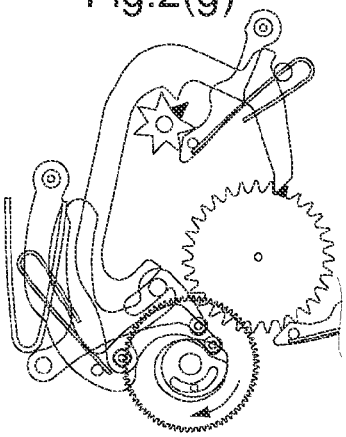
Figure 3A:
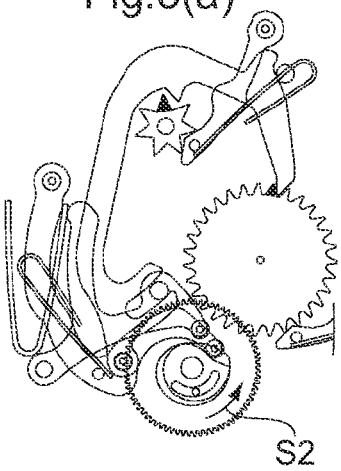
FIG. 3 shows a sequence of states of the calendar mechanism according to the first embodiment during rotation of the time indicators of the timepiece by a number of revolutions corresponding to 24 hours of time display in the anti-clockwise direction.
Figure 3B:
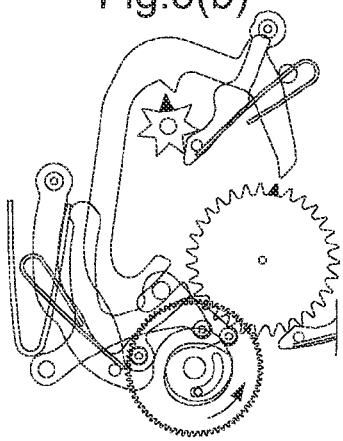
Figure 3C:
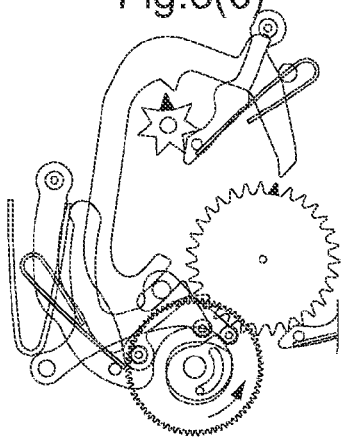
Figure 3D:
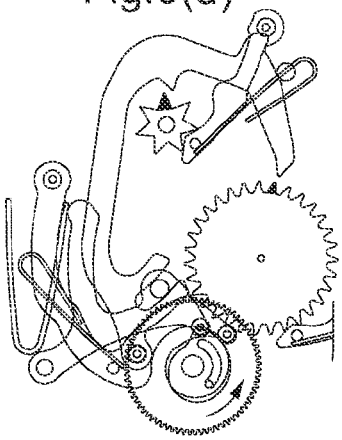
Figure 3E:
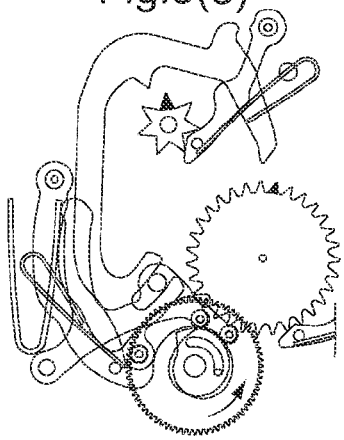
Figure 3F:
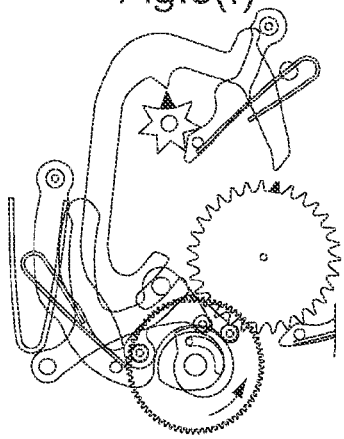
Figure 3G:
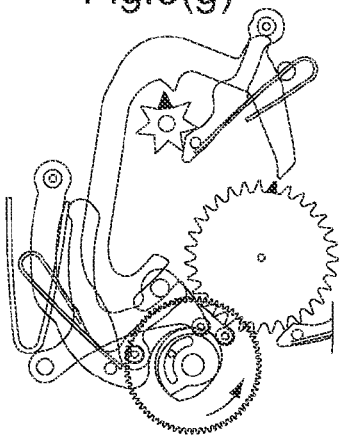
Figure 3H:
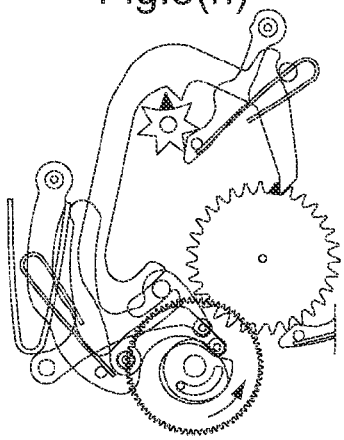

With reference to FIG. 1, a calendar mechanism according to a first embodiment of the invention for a timepiece such as a wrist watch has a calendar wheel 1 driven in a conventional manner by the going train of the timepiece during normal operation thereof. The calendar wheel 1 thus rotates at a rate of one revolution per 24 hours in the direction indicated by the arrow S1. During time setting of the timepiece, the calendar wheel 1 is driven by the time-setting gear train in one direction or the other.

Two cams, i.e. a calendar cam 2 and an isolating cam 3, are coaxial with the calendar wheel 1. An eccentric pin 4 driven into the calendar cam 2 is engaged in an opening 5 in the calendar wheel 1, said opening 5 being in the form of an arc of a circle and comprising a first end 6 and a second end 7. The pin 4 and the opening 5 define a range of rotation of the calendar cam 2 with respect to the calendar wheel 1. The isolating cam 3 is fixedly attached to the calendar wheel 1. Each of the cams 2, 3 has an arming part 2*a*, 3*a*, of increasing radius, between a lower part 2*b*, 3*b* and a peak 2*c*, 3*c* and a shorter, plunging part 2*d*, 3*d* between the peak 2*c*, 3*c* and the lower part 2*b*, 3*b*. In the illustrated example, the lower part 2*b* of the calendar cam 2 defines a hollow and its plunging part 2*d* is convex and has a positive slope. The plunging part 3*d* of the isolating cam 3 is substantially straight and has a positive slope.

A cam lever 8 mounted about a pivot 9 is applied for part of the time against the calendar cam 2 by a spring 10. An isolating lever 11 mounted about a pivot 12 is applied against the isolating cam 3 by a spring 13. The pivots 9, 12 are mounted on a fixed piece of the timepiece movement, such as the bottom plate or a bridge. The contact between the levers 8, 11 and the cams 2, 3 is preferably effected by means of rollers 14, 15 respectively mounted on the levers 8, 11 and which roll on the cams 2, 3. However, in a variation, beaks of the levers 8, 11 could cooperate directly with the cams 2, 3.

A calendar lever or "actuating lever" 16 is mounted about a pivot 17 carried by the isolating lever 11 and has a U-shaped oblong opening 18 which receives a pin 19 carried by the cam lever 8. Thus the calendar lever 16 is controlled both by the cam lever 8, thus by the calendar cam 2, and by the isolating lever 11, thus by the isolating cam 3. The calendar lever 16 has beaks 20, 21 which cooperate respectively with a date star 22 and a day star 23. Indicators such as hands or discs are fixedly attached to the stars 22, 23 respectively and indicate to the user the day of the month and the day of the week in cooperation with graduations or apertures in a dial of the timepiece.

FIGS. 2(*a*) to 2(*g*) show different successive configurations of the calendar mechanism according to this first embodiment of the invention during normal operation of the timepiece or during time setting in the forward direction, i.e. in the clockwise direction of the time indicators of the timepiece, wherein the calendar wheel 1 and, with it, the isolating cam 3 rotate in the direction S1. FIG. 2(*a*), like FIG. 1, illustrates the configuration of the calendar mechanism just after midnight: the calendar lever 16 is in abutment against an abutment pin 24, the beaks 20, 21 of the calendar lever 16 are in the toothing of the stars 22, 23 respectively, the cam lever 8 is out of contact with the calendar cam 2 because it is held against the action of the spring 10 by the calendar lever 16 which cooperates with the pin 19, the isolating lever 11 is applied against the lower part 3*b* of the isolating cam 3 and the pin 4 is moved away from the ends of the oblong opening 5, in particular from the first end 6. From this configuration, the cooperation between the arming part 3*a* of the isolating cam 3 and the isolating lever 11 causes the isolating lever 11 to be raised against the action of the spring 13, which raises the calendar lever 16 of which the pivot 17 is carried by the isolating lever 11 (FIG. 2(*b*)). The beaks 20, 21 of the calendar lever 16 thus begin to leave the toothing of the stars 22, 23 without modifying the angular position of the said stars. The calendar cam 2 remains immobile until the first end 6 of the oblong opening 5 meets the pin 4, causing the calendar cam 2 to be fixed relative to the calendar wheel 1 and to the isolating cam 3 (FIG. 2(*c*)). The cam lever 8 then comes into contact with the arming part 2*a* of the calendar cam 2 and is raised thereby (FIGS. 2(*d*) and 2(*e*)), and the calendar lever 16, of which the beaks 20, 21 have now completely left the toothing of the stars 22, 23, continues to move away from the stars 22, 23. The calendar lever 16 which, since the beginning of the movement, was guided by the abutment pin 24 (FIGS. 2(*a*) to 2(*d*)), moves away therefrom (FIG. 2(*e*)). Near the end of a revolution of the date wheel 1, i.e. just before midnight, the isolating lever 11 passes from the peak 3*c* to the lower part 3*b* of the isolating cam 3 (FIG. 2(*f*)), which moves the calendar lever 16 towards the stars 22, 23. Then, at midnight, it is the cam lever 8 which passes the peak 2*c* of the calendar cam 2, causes it to rotate suddenly under the action of the spring 10 (which is made possible by the cooperation between the pin 4 and the oblong opening 5) and, in falling, drives the calendar lever 16, of which the beaks 20, 21 re-enter the toothing of the stars 22, 23, causing the stars 22, 23 to rotate by one step (FIG. 2(*g*)). Solely for the purpose of understanding the drawings, one tooth 25, 26 of each of the stars 22, 23 has been marked to show that the position of the stars 22, 23 has changed in FIG. 2(*g*) with respect to FIGS. 2(*a*) to 2(*f*). In FIG. 2(*g*), the cams 2, 3 and the levers 8, 11, 16 are in their position of FIG. 2(*a*) again.

FIGS. 3(*a*) to 3(*h*) show different successive configurations of the calendar mechanism according to this first embodiment of the invention during time setting in the backwards direction, i.e. in the anti-clockwise direction of the indicators of the time display, wherein the calendar wheel 1 and, with it, the isolating cam 3 rotate in a direction S2 opposite to the direction 51. FIG. 3(*a*), like FIG. 1, illustrates the configuration of the calendar mechanism just after midnight: the calendar lever 16 is in abutment against the abutment pin 24, the beaks 20, 21 of the calendar lever 16 are in the toothing of the stars 22, 23 respectively, the cam lever 8 is out of contact with the calendar cam 2 because it is held against the action of the spring 10 by the calendar lever 16 which cooperates with the pin 19, the isolating lever 11 is applied against the lower part 3*b* of the isolating cam 3 and the pin 4 is moved away from the ends of the oblong opening 5, in particular from the second end 7. The isolating lever 11 is raised from the lower part 3*b* to the peak 3*c* of the isolating cam 3 by the plunging part 3*d* (FIG. 3(*b*)), which causes the beaks 20, 21 of the calendar lever 16 to leave the toothing of the stars 22, 23 without modifying the angular position of the stars 22, 23, then begins to descend along the part 3*a* of the isolating cam 3. The calendar cam 2 remains immobile until the second end 7 of the oblong opening 5 meets the pin 4, thus causing the calendar cam 2 to be fixed relative to the calendar wheel 1 (FIG. 3(*c*)). The cam lever 8 then comes into contact with the plunging part 2*d* of the calendar cam 2 and is raised thereby (FIGS. 3(*d*) and 3(*e*)). The calendar lever 16, which from the start of the movement was guided by the abutment pin 24 (FIGS. 3(*a*) to 3(*d*)), moves away therefrom (FIG. 3(*e*)). When the cam lever 8 reaches the peak 2*c* of the calendar cam 2 (FIG. 3(*e*)), the calendar lever 16 is still further away from the stars 22, 23. The cam lever 8 thus causes the calendar cam 2 to rotate rapidly in the direction S2 by its abutment on the part 2*a* of the cam 2 (FIG. 3(*f*)). This movement moves the calendar lever 16 towards the stars 22, 23 by the cooperation between the pin 19 and the U-shaped oblong opening 18. The cam lever 8 and the isolating lever 11 continue their descent along the calendar cam 2 and the isolating cam 3 respectively (FIG. 3(*g*)) until they are located in the position described in relation to FIG. 3(*a*) where the cam lever 8 is out of contact with the calendar cam 2 and the isolating lever 11 is on the lower part 3*b* of the isolating cam 3 (FIG. 3(*h*)). The beaks 20, 21 of the calendar lever 16 re-enter the respective toothings of the stars 22, 23 without driving them, i.e. they return to their position in FIG. 3(*a*) without modifying the angular position of the stars 22, 23.

Thus in each 24 hour period, from midnight to midnight, during normal operation of the timepiece or during time setting in the forwards direction, the calendar lever 16 effects an outward movement which causes its beaks 20, 21 to leave the toothing of the stars 22, 23 without modifying the angular position thereof, then a return movement which causes its beaks 20, 21 to re-enter the toothing of the stars 22, 23, causing the said stars to advance by one step. In each 24 hour period, from midnight to midnight, but in the reverse direction, during time setting in the backwards direction, the calendar lever 16 effects an outward movement which causes its beaks 20, 21 to leave the toothing of the stars 22, 23 without modifying the angular position thereof, then a return movement which causes its beaks 20, 21 to re-enter the toothing of the stars 22, 23 without modifying the angular position thereof and thus without causing any change to appear in the calendar display.

The present invention thus permits the user to set the timepiece in the backwards direction at any time without the passage through midnight in the reverse direction causing the calendar display indicators to advance. This is made possible by the fact that, by virtue of the oblong opening 5, the two cams 2, 3 have relative angular positions which differ depending on the direction of rotation of the calendar wheel 1 (cf. FIG. 3(*c*) compared to FIG. 2(*c*)) and that consequently the movement of the calendar lever 16 differs depending on the direction of rotation of the calendar wheel 1. It will also be noted that, due to the trajectory followed by the beaks 20, 21 of the calendar lever 16, these do not have to be pivoting, they can be rigid as shown. The advantage of having rigid beaks is that they prevent the stars 22, 23 from advancing by more than one step under the effect of their inertia at the time of a change in date.

Figure 4:
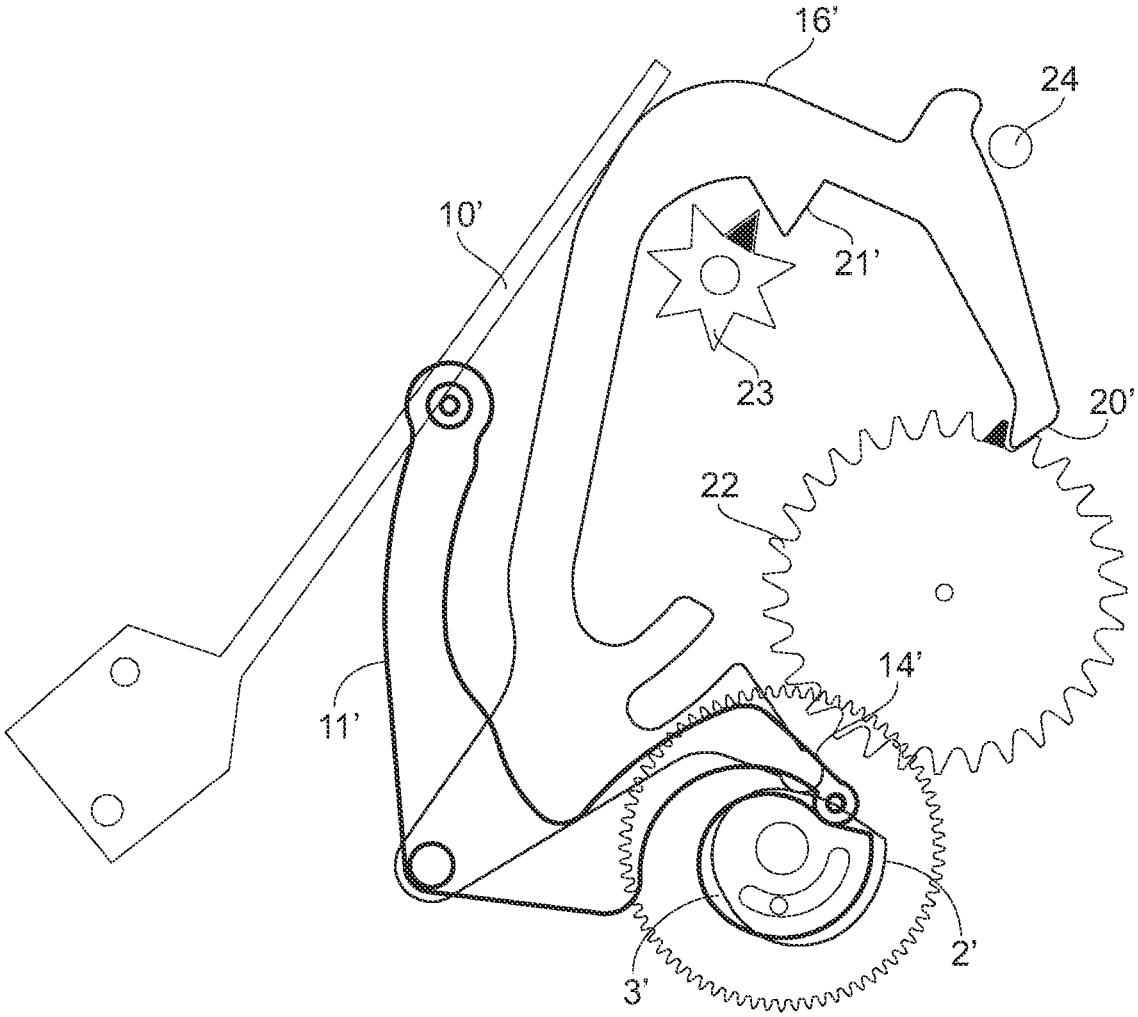
FIG. 4 shows a calendar mechanism according to a second embodiment of the invention.
Figure 5A:
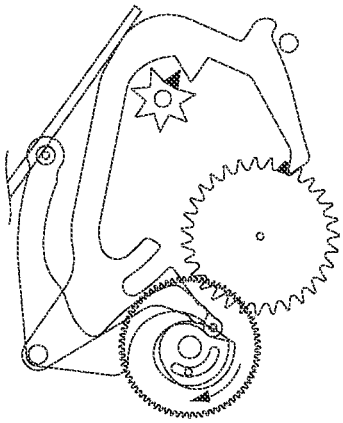
FIG. 5 shows a sequence of states of the calendar mechanism according to the second embodiment during rotation of the time indicators of the timepiece by a number of revolutions corresponding to 24 hours of time display in the clockwise direction.
Figure 5B:
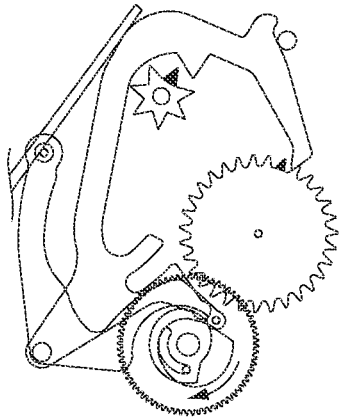
Figure 5C:
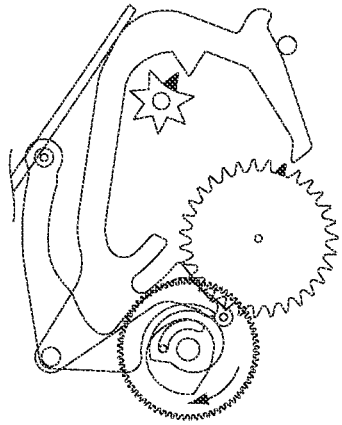
Figure 5D:
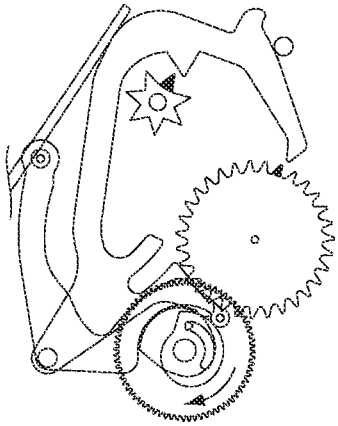
Figure 5E:
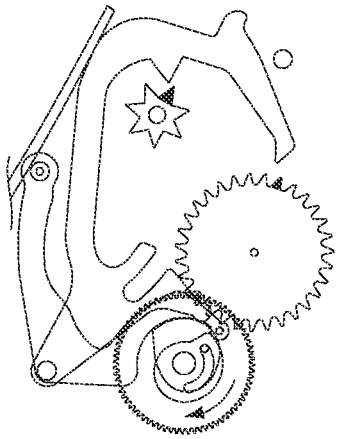
Figure 5F:
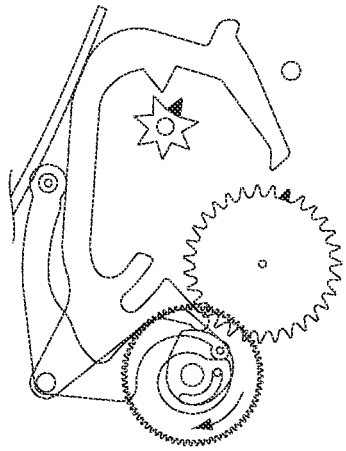
Figure 5G:
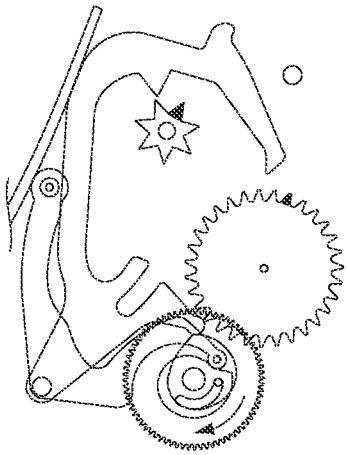
Figure 5H:
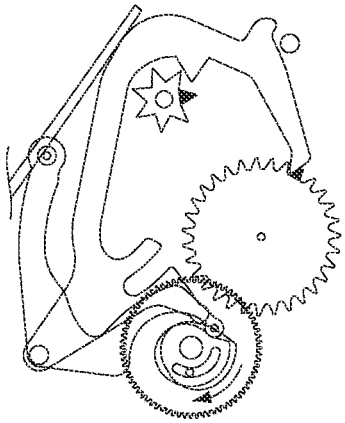
Figure 6A:
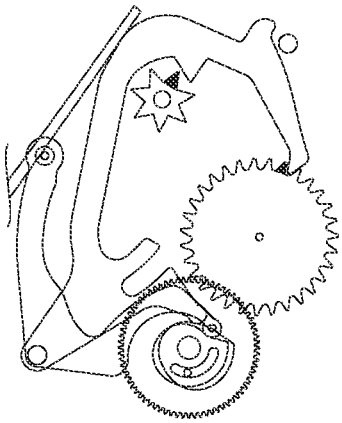
FIG. 6 shows a sequence of states of the calendar mechanism according to the second embodiment during rotation of the time indicators of the timepiece by a number of revolutions corresponding to 24 hours of time display in the anti-clockwise direction.
Figure 6B:
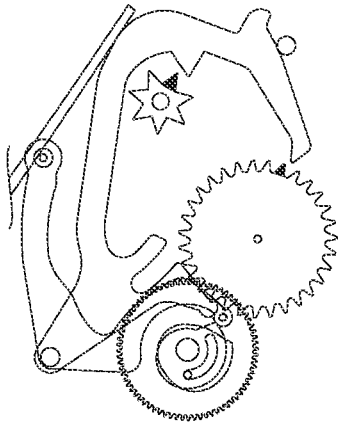
Figure 6C:
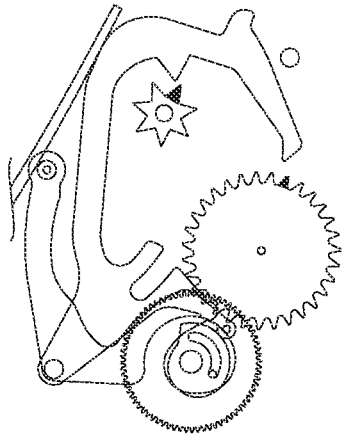
Figure 6D:
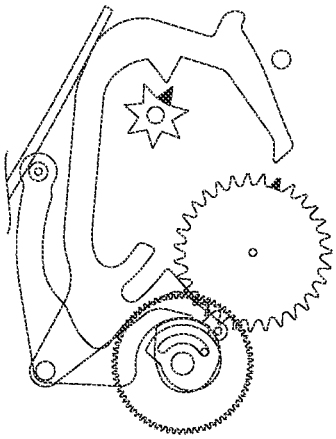
Figure 6E:
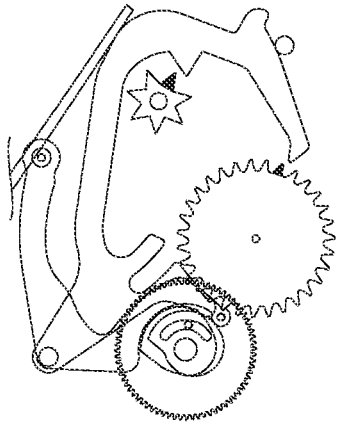
Figure 6F:
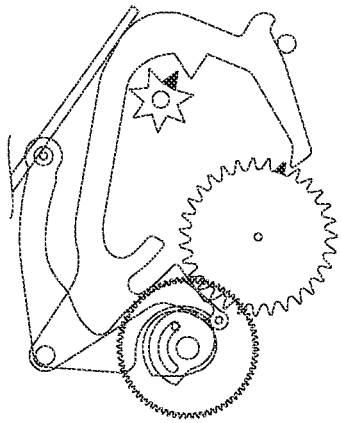
Figure 6G:
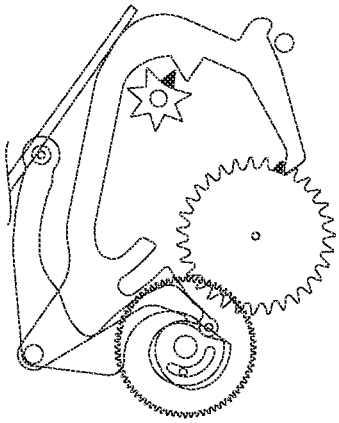

FIG. 4 shows a calendar mechanism according to a second embodiment of the invention. The calendar mechanism according to this second embodiment differs from that of the first embodiment in that the cam lever 8 is omitted and in that the calendar lever, designated by the number 16', cooperates with the calendar cam 2' instead of the cam lever 8, has for this purpose a roller 14' or a beak and is directly subject to the action of a return spring 10'. Although not shown in FIG. 4, a return spring could also act on the isolating lever 11'. The respective shapes of the calendar cam 2', of the isolating cam 3', of the calendar lever 16' and of the isolating lever 11' which carries the pivot of the calendar lever 16' and cooperates with the isolating cam 3' are slightly modified with respect to the first embodiment. The other pieces of the mechanism are unchanged.

According to the same principle as the movement described in relation to FIG. 2, in each 24 hour period, from midnight to midnight, during normal operation of the timepiece or during forwards time setting, the calendar lever 16' carried by the isolating lever 11' and guided at certain moments by the abutment pin 24 effects an outward movement which causes the beaks 20', 21' to leave the toothing of the stars 22, 23 without modifying the angular position thereof, then a return movement which causes its beaks 20', 21' to re-enter the toothing of the stars 22, 23, causing the said stars to advance by one step. FIGS. 5(*a*) to 5(*h*) show different successive configurations of the calendar mechanism during this movement.

According to the same principle as the movement described in relation to FIG. 3, in each 24 hour period, from midnight to midnight, but in the reverse direction, during backwards time setting, the calendar lever 16' effects an outward movement which causes the beaks 20', 21' to leave the toothing of the stars 22, 23 without modifying the angular position thereof, then a return movement which causes its beaks 20' 21' to re-enter the toothing of the stars 22, 23 without modifying the angular position thereof and thus without causing a change to appear in the calendar display. FIGS. 6(*a*) to 6(*g*) show different successive configurations of the calendar mechanism during this movement.

The calendar mechanism according to the second embodiment has the advantage of having fewer parts than that according to the first embodiment. The first embodiment, on the other hand, is advantageous in a number of respects:

- it makes it possible to control the equilibrium between the return springs of the levers more easily;
- it avoids the use of a return spring for the calendar lever, a return spring of which the abutment against the calendar lever generates friction owing to the translational component comprised by the movement of this lever;
- it permits the use of a smaller calendar cam.

With the calendar mechanism as described above, according to the first or second embodiment, a correction in the date or day independent of the time display is prevented when the beaks 20, 21 of the calendar lever 16 are engaged in the toothing of the stars 22, 23 since these beaks 20, 21 block the rotation of the stars 22, 23. In order to overcome this problem, the mechanism in accordance with the invention has a correction device illustrated in FIGS. 7 and 8.

Figure 7:
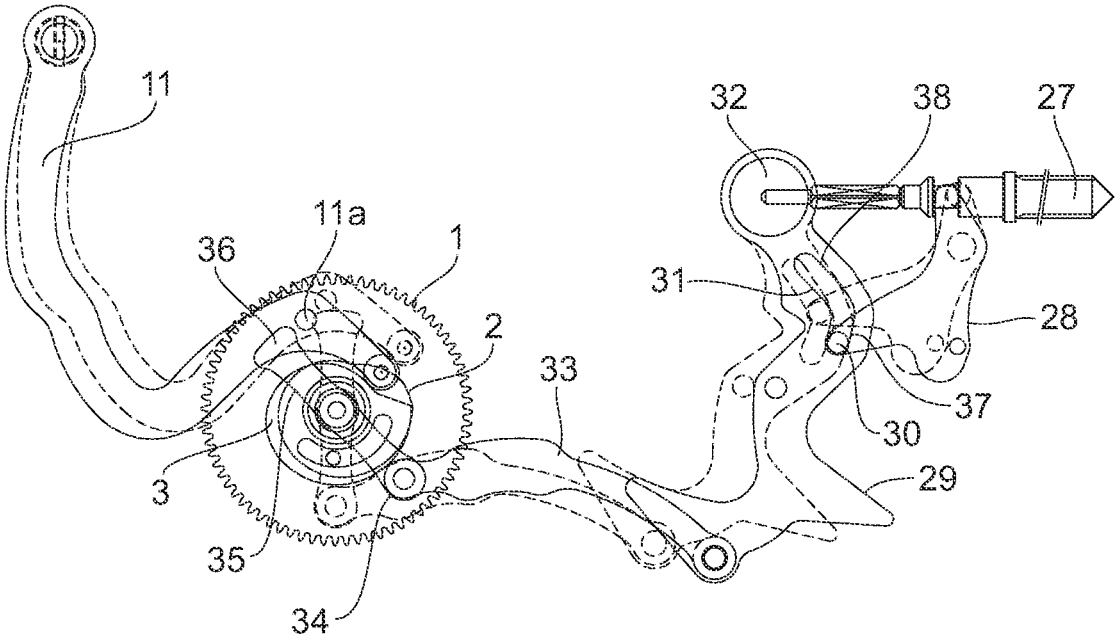
FIG. 7 shows a part of a correction device included in the calendar mechanism in accordance with the invention.

The correction device has, as shown in FIG. 7, the winding stem 27 of the timepiece which can adopt three axial positions, i.e. a winding position (pushed-in position), a position for correcting the date (intermediate position) and a time-setting position (pulled-out position). A pull-out piece 28 cooperates with the winding stem 27 to control the winding sliding pinion (not shown) in a conventional manner. In the present invention, the pull-out piece 28 also controls a lever 29 by means of a pin 30 fixedly attached to the pull-out piece 28 and engaged in an angle-bent oblong opening 31 of the lever 29. The lever 29 pivots at a point 32. A connecting rod 33 is articulated by one of its ends to the lever 29 and by its other end to a first end 34 of a second lever 35. The lever 35 pivots about the common axis of rotation of the calendar wheel 1 and of the cams 2, 3 and has a second end 36 located on the other side of the said axis with respect to the first end 34. When the winding stem 27 is in the winding or time-setting position, the levers 29, 35 and the connecting rod 33 are in their position shown in a solid line in FIG. 7, where the lever 35 does not act on the isolating lever 11 which remains in abutment against the isolating cam 3. When the winding stem 27 is in the position for correcting the date, the levers 29, 35 and the connecting rod 33 are in their position shown in a dotted line, where the isolating lever 11 is raised and distanced from the isolating cam 3 by the action of the second end 36 of the lever 35 on a pin 11*a* carried by the isolating lever 11. In this position, the beaks 20, 21 of the calendar lever 16 are outside the toothing of the stars 22, 23 and the winding stem 27 can be rotated to cause the date star 22 to rotate by means of a gear train (not shown). The fact that the levers 29, 35 and the connecting rod 33 have the same position when the winding stem 27 is in the winding or time-setting position is made possible by the angle-bent shape of the oblong opening 31. In the position for correcting the date of the winding stem 27, the pin 30 is located in the angle of the opening 31. Between the position for correcting the date and the winding position, the pin 30 cooperates with a portion 37 of the opening 31 extending from the angle to a first end of the opening. Between the position for correcting the date and the time-setting position, the pin 30 cooperates with the other portion 38 of the opening 31 extending from the angle to the second end of the opening.

Figure 8:
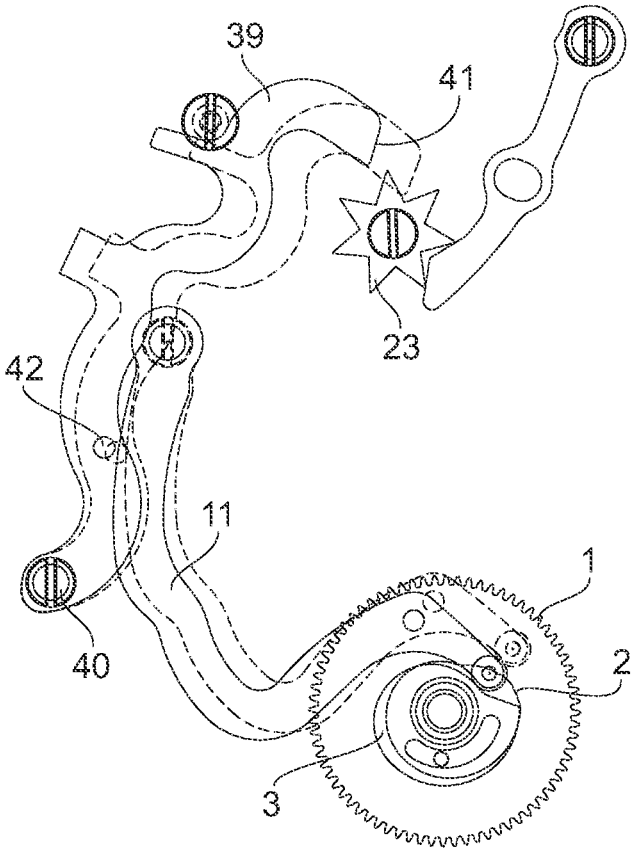
FIG. 8 shows another part of the correction device.

Another part of the correction device is shown in FIG. 8. This part is involved with the correction of the days. A day corrector 39, in the form of a lever actuated by a push button (not shown) and pivoting at a point 40, has a beak 41 which displaces by one step the day star 23 each time the corrector 39 is actuated. The corrector 39 is subject to the action of a return spring (not shown). The corrector carries a pin 42 which raises the isolating lever 11 upon each actuation of the corrector 39. The raising of the isolating lever 11 moves the calendar lever 16 away from the stars 22, 23 and in particular causes the beak 21 to exit the toothing of the day star 23 before the beak 41 of the corrector 39 engages in the said toothing.

Figure 9:
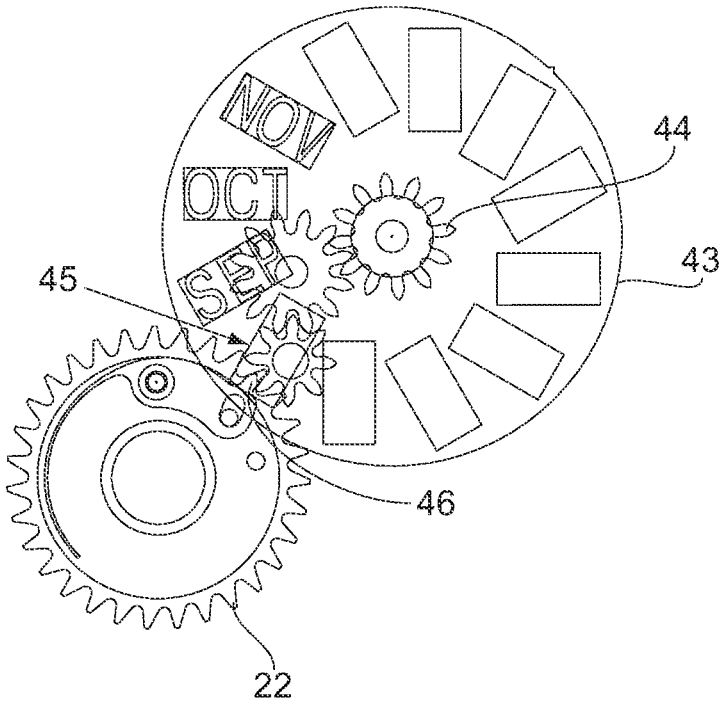
FIG. 9 shows a part for displaying the months of the calendar mechanism in accordance with the invention.

The calendar mechanism in accordance with the invention can also have a month indicator. FIG. 9 shows an example of such an indicator in the form of a disc 43 having indications for the 12 months. This indicator 43 is fixedly attached to a month pinion 44 which is driven by a gear train 45, itself driven by a retractable finger 46 carried by the date star 22. The finger 46 is placed so that the month pinion 44 is driven by one step upon passage of the date from the $31^{st}$ to the $1^{st}$. If a correction of the month display by a mechanism, not shown, is effected while the finger 46 is engaged in a toothing of the gear train 45, the finger 46 is refracted to prevent any blocking of the month pinion 44. The mechanism permitting the correction of the month display is e.g. a gear train connected to the winding stem by a lever so that when the winding stem is located in the axial position for correction of the date, a rotation of the stem in a determined direction corrects the angular position of the month pinion 44 while a rotation of the stem in the other direction corrects the angular position of the date star 22 by means of the said lever and of the gear train for correction of the date.

The invention claimed is:

1. Calendar mechanism for a timepiece, comprising:

at least one mobile (22; 23) for driving an indicator, a wheel (1) which, during normal operation of the timepiece, is driven in a first direction (S1), and a lever (16) for actuating the mobile (22; 23), characterised in that it further comprises first and second cams (2, 3) driven by the wheel (1) and controlling the movements of the actuating lever (16), these first and second cams (2, 3) being arranged so that their relative angular position differs depending on the direction of rotation of the wheel (1) so that the movements of the actuating lever (16) cause the mobile (22; 23) to advance periodically during normal operation of the timepiece and do not permit the mobile (22; 23) to advance during backwards time setting of the timepiece causing the wheel (1) to rotate in a second direction (S2) opposite to the first direction (S1).

2. Calendar mechanism as claimed in claim 1, characterised in that the first and second cams (2, 3) are coaxial to the wheel (1).

3. Calendar mechanism as claimed in claim 2, characterised in that the connection between the wheel (1), the first cam (2) and the second cam (3) comprises an oblong opening (5) and a pin (4) engaged in the oblong opening (5).

4. Calendar mechanism as claimed in claim 3, characterised in that the oblong opening (5) is provided in the wheel (1), the pin (4) is carried by the first cam (2) and the second cam (3) is fixedly attached to the wheel (1).

5. Calendar mechanism as claimed in claim 1, characterised in that the second cam (3) controls the actuating lever (16) via a second lever (11).

6. Calendar mechanism as claimed in claim 5, characterised in that the pivot (17) of the actuating lever (16) is carried by the second lever (11).

7. Calendar mechanism as claimed in claim 1, characterised in that the first cam (2) controls the actuating lever (16) by means of a third lever (8).

8. Calendar mechanism as claimed in claim 7, characterised in that the connection between the actuating lever (16) and the third lever (8) comprises an oblong opening (18) and a pin (19) engaged in the oblong opening (18).

9. Calendar mechanism as claimed in claim 8, characterised in that the oblong opening (18) is provided in the actuating lever (16) and the pin (19) is carried by the third lever (8).

10. Calendar mechanism as claimed in claim 1, characterised in that the actuating lever (16) comprises at least one beak (20; 21) and is arranged so that during normal operation of the timepiece this beak (20; 21) periodically engages in a toothing of the mobile (22; 23) in order to cause this mobile to advance and so that the engagements of this beak in the toothing of the mobile (22; 23) during backwards time setting of the timepiece have no effect on the angular position of the said mobile.

11. Calendar mechanism as claimed in claim 10, characterised in that it comprises a device (28-36; 39-42) to cause the beak (20; 21) to automatically leave the toothing of the mobile (22; 23) before a correction of the position of the said mobile.

12. Calendar mechanism as claimed in claim 11, characterised in that the said device (28-36) can be actuated by a displacement of a winding stem (27) into a predetermined axial position.

13. Calendar mechanism as claimed in claim 11, characterised in that the second cam (3) controls the actuating lever (16) via a second lever (11), and wherein said device (28-36; 39-42) comprises means (35, 36; 42) for moving the second lever (11) away from the second cam (3), this distancing movement causing a displacement of the actuating lever (16) causing the beak (20; 21) to leave the toothing of the mobile (22; 23).

14. Calendar mechanism as claimed in claim 12, characterised in that the second cam (3) controls the actuating lever (16) via a second lever (11) and the pivot (17) of the actuating lever (16) is carried by the second lever (11), and wherein said device (28-36; 39-42) comprises means (35, 36; 42) for moving the second lever (11) away from the second cam (3), this distancing movement causing a displacement of the actuating lever (16) causing the beak (20; 21) to leave the toothing of the mobile (22; 23).

* * * * *